US009734965B2

(12) United States Patent
Verdú Martínez et al.

(10) Patent No.: US 9,734,965 B2
(45) Date of Patent: Aug. 15, 2017

(54) ARRANGEMENT OF PUSHBUTTON SWITCHES WITH A PROGRAMMABLE DISPLAY

(71) Applicants: Juan José Verdú Martínez, Sant Boi de Lllobregat Barcelona (ES); Miguel Ángel Lorenzo Riera, Santa Coloma de Cervello Barcelona (ES)

(72) Inventors: Juan José Verdú Martínez, Sant Boi de Lllobregat Barcelona (ES); Miguel Ángel Lorenzo Riera, Santa Coloma de Cervello Barcelona (ES)

(73) Assignee: INDUSTRIAS LORENZO, S.A., Sant Climent de Lllobregat, Barcelona (ES)

( * ) Notice: Subject to any disclaimer, the term of this patent is extended or adjusted under 35 U.S.C. 154(b) by 10 days.

(21) Appl. No.: 14/492,526

(22) Filed: Sep. 22, 2014

(65) Prior Publication Data

US 2015/0083564 A1 Mar. 26, 2015

(30) Foreign Application Priority Data

Sep. 23, 2013 (ES) ..... 201331996 U

(51) Int. Cl.
*H01H 9/26* (2006.01)
*H01H 13/72* (2006.01)
(Continued)

(52) U.S. Cl.
CPC ..... *H01H 13/83* (2013.01); *H01H 9/181* (2013.01); *H01H 13/704* (2013.01);
(Continued)

(58) Field of Classification Search
CPC H01H 9/16; H01H 9/26; H01H 13/72; H01H 13/76; H01H 3/00; H01H 3/02;
(Continued)

(56) References Cited

U.S. PATENT DOCUMENTS 3,710,060 A * 1/1973 Brevick ..... H02B 1/042 200/243
4,487,469 A * 12/1984 Bjork ..... H01R 33/9753 403/349
(Continued)

FOREIGN PATENT DOCUMENTS

EP A1-1347363 9/2003
EP A1-1589551 10/2005
(Continued)

*Primary Examiner* — Anthony R. Jimenez
(74) *Attorney, Agent, or Firm* — Robert J. Hess; Hess Patent Law Firm

(57) ABSTRACT

An arrangement of pushbutton switches with a programmable display that has a support structure with an assembly panel with openings for arranging there through an enclosure body of each push-button switch of the arrangement; a printed circuit board; and a shielding plate, wherein the enclosure body of each pushbutton comprises an appendix arranged through through-openings defined in the assembly panel, printed circuit board and plate; and a connector attached to the enclosure body that is opposite to and engaged with a connector of the printed circuit board, wherein each enclosure body is attached to the support structure by removable immobilizing means of said appendix with respect to said shielding plate, the immobilizing means comprising a nut with a coupling configuration to be coupled to a tubular shaft by a respective complementary coupling configuration integrated with or attached to the tubular shaft.

8 Claims, 5 Drawing Sheets

(51) Int. Cl.

| | |
|---|---|
| ***H01H 13/76*** | (2006.01) |
| ***H01H 13/83*** | (2006.01) |
| ***H01H 13/704*** | (2006.01) |
| ***H01H 9/18*** | (2006.01) |
| *H01H 1/58* | (2006.01) |

(52) U.S. Cl.
CPC ..... *H01H 2001/5816* (2013.01); *H01H 2219/016* (2013.01); *H01H 2219/037* (2013.01); *H01H 2219/04* (2013.01); *H01H 2219/042* (2013.01); *H01H 2219/046* (2013.01); *H01H 2219/066* (2013.01)

(58) Field of Classification Search
CPC .. H01H 3/12; H01H 9/00; H01H 9/02; H01H 9/08; H01H 9/20; H01H 9/22; H01H 9/24; H01H 9/28; H01H 9/285; H01H 9/286; H01H 9/287; H01H 13/00; H01H 13/02; H01H 13/04; H01H 13/06; H01H 13/10; H01H 13/12; H01H 13/14; H01H 13/20; H01H 13/50; H01H 13/52; H01H 13/70; H01H 2003/00; H01H 2003/02; H01H 2003/12; H01H 2009/02; H01H 2009/20; H01H 2013/00; H01H 2013/50; H01H 2013/02; H01H 2071/10; H01H 2071/1009; H01H 2071/1054; H01H 2223/01; H01H 2223/034; H01H 2223/036; H01H 2231/00; H01H 2231/012; H01H 2231/026; H01H 2233/00; H01H 2233/008; H01H 2233/012; H01H 2233/024; H01H 2233/02603; H01H 2233/046; H01H 2233/066; H01H 2233/05; H01H 2233/07; H01H 2233/086; H01H 2233/09; H01H 2233/106
USPC ..... 200/5 A, 314, 292, 317, 310, 311, 312, 200/313, 315, 316, 67 D, 67 DA
See application file for complete search history.

(56) References Cited

U.S. PATENT DOCUMENTS

| | | | | |
|---|---|---|---|---|
| D514,072 | S | 1/2006 | Martinez | |
| 8,410,383 | B2 | 4/2013 | Clark et al. | |
| 8,558,130 | B2 | 10/2013 | Verd Martinez et al. | |
| 2007/0193867 | A1 | 8/2007 | Lorenzo Riera et al. | |
| 2007/0246337 | A1 | 10/2007 | Verdu et al. | |
| 2009/0194401 | A1* | 8/2009 | Kim | G06F 3/0202 200/314 |
| 2010/0188329 | A1 | 7/2010 | Lorenzo Riera et al. | |
| 2012/0094545 | A1 | 4/2012 | Lorenzo Riera et al. | |
| 2012/0097513 | A1* | 4/2012 | He | H01H 13/705 200/5 A |
| 2013/0026017 | A1 | 1/2013 | Verd Martinez et al. | |
| 2013/0140165 | A1* | 6/2013 | Lin | G06F 3/0202 200/5 A |

FOREIGN PATENT DOCUMENTS

| | | |
|---|---|---|
| EP | A1-2110833 | 10/2009 |
| EP | A-2211361 | 7/2010 |

* cited by examiner

ARRANGEMENT OF PUSHBUTTON SWITCHES WITH A PROGRAMMABLE DISPLAY

FIELD OF THE ART

The present invention relates to an arrangement of push-button switches with a programmable display, in particular a display with OLED (short for "organic light-emitting diode") diodes included in the push-button head and supported on a push-button actuator member having limited linear shift play inside an enclosure body that has an affixed micro switch, which is activated by said linear shift when the push-button is operated.

The invention provides, to that effect, a support structure of a plurality of pushbutton switches that are coupled to a printed circuit board forming a functional arrangement, so that any of the pushbutton switches of the arrangement may be easily replaced without the need of handling connection cables.

Each of the pushbutton switches further comprises an enclosure body made of a light-conducting material that is associated in said support structure to lighting LED diodes so as to provide lighting to a frame of said enclosure body. Said LED diodes may in turn be connected via said printed circuit board to a control unit for their dynamic activation, generating movement effects in the luminous aureole provided.

STATE OF THE PRIOR ART

Switching devices that include a display in their head are known from documents EP-A1-1347363 and EP-A1-1589551.

Patent applications EP-A1-2110833 and EP-A1-2211361 describe such pushbutton switches with and OLED display.

U.S. Pat. No. 8,410,383 B1 describes, as prior art, a plurality of pushbutton switches grouped together in a unit via a support structure according to the general characteristics defined in the preamble of claim 1, i.e. formed by an assembly panel, a printed circuit board and a shielding plate fixed to one another in a sandwich arrangement, but where each pushbutton switch is coupled to the support structure through auxiliary boards and support frames attached to the printed circuit board, so that when there is a need of removing one of the pushbutton switches, for example in order to substitute it because of malfunctioning, such a substitution task is a very laborious task, because in order to carry it out it is necessary, first, uncoupling the whole support structure so that the assembly panel can be removed and, then, individually uncoupling the damaged pushbutton switch from its respective support frame.

In connection with the latter background art, the invention proposes a support structure and integration means of a plurality of push-buttons in an assisting and/or connecting printed circuit board (it may include local control units) that involve a remarkable simplification with respect to said background art and an improvement of the capabilities, especially with respect to the mentioned substitution of a damaged pushbutton switch, being possible to perform such a task in a simple manner without having to uncouple the whole support structure but only individually the pushbutton switch.

DISCLOSURE OF THE INVENTION

According to what has been set forth above, the invention is intended for grouping an arrangement of pushbutton switches with a programmable display in an operating unit or block, each of which comprises a display, visible from outside, installed in an actuator member of the push-button that exhibits limited linear shift play inside an enclosure body that has an affixed micro switch, which is activated by said linear shift when the push-button is operated. Said display is covered by a lens and by a transparent cover.

In order to group a plurality of pushbutton switches with a display and even other standard pushbutton switches, a support structure has been provided comprising:

- an assembly panel with a plurality of openings for arranging there through the enclosure body of each pushbutton switch of the arrangement, with the support of a bezel on the sides of said opening, on said panel;
- a printed circuit board wherein connection and/or control elements of said display and micro switches of said plurality of pushbutton switches are arranged;
- a shielding plate of said printed circuit board; and
- separating or spacing columns and attachment means linking said panel, printed circuit board and plate in an overlapping arrangement.

According to the proposal of this invention, the enclosure body of each pushbutton switch comprises, in turn:

- an appendix intended to be arranged through through-openings defined in said panel, printed circuit board and plate, said through-openings facing each other (for example being vertically aligned) in said support structure; and
- the enclosure body includes, attached or integrated thereto, a first insertion connector that is opposite to and engaged with, in an assembled situation, a second connector provided and arranged in said printed circuit board for connecting the corresponding display and the micro switch.

In addition, removable immobilizing means of said appendix with respect to said shielding plate have been provided, through which each enclosure body is attached to said support structure. According to a preferred embodiment, said immobilizing means comprise a nut with a coupling configuration to be coupled to said tubular shaft by a respective complementary coupling configuration integrated with or attached to the tubular shaft, so that said nut is tight against said shielding plate, suitably securing the pushbutton switch. Said coupling configurations are, for a preferred embodiment, bayonet coupling configurations, although, for other embodiments, less preferred, other kind of coupling configurations are possible, such as those formed by complementary screw threads.

The printed circuit board includes one or several LEDs that, in an assembled situation, are close to walls of said enclosure body of each of the pushbutton switches, said enclosure being made of a light-conducting material so that the lighting of said LEDs is transferred through the enclosure body to said bezel above the panel.

Other characteristics of the invention will appear in the following detailed description of some embodiments.

BRIEF DESCRIPTION OF THE DRAWINGS

The above and other advantages and characteristics will be more fully understood from the following detailed description of embodiments in reference to the attached drawings, which are to be taken by way of illustration, not limitation, wherein.

DETAILED DESCRIPTION OF EMBODIMENTS

The invention proposes an arrangement of pushbutton switches with a programmable display, wherein said display 54, visible from the outside, is arranged in an actuator member of the push-button 58 having limited linear shift play inside an enclosure body 50 that includes an affixed micro switch, which is activated by said linear shift when the push-button is operated.

Figure 1A:
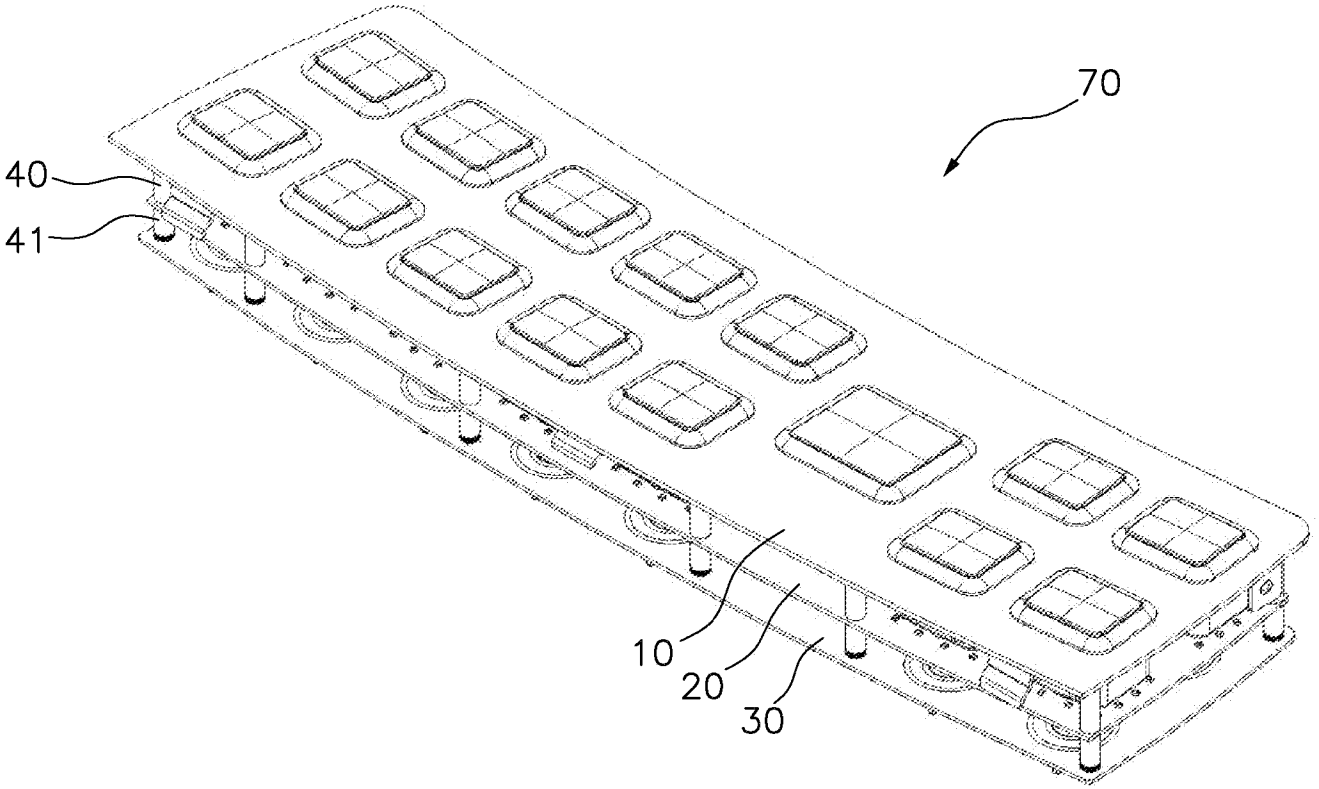
FIG. 1A shows an axonometric view of an arrangement of pushbutton switches with a programmable display included in a support structure, the side provided with the push-buttons being visible.
Figure 1B:
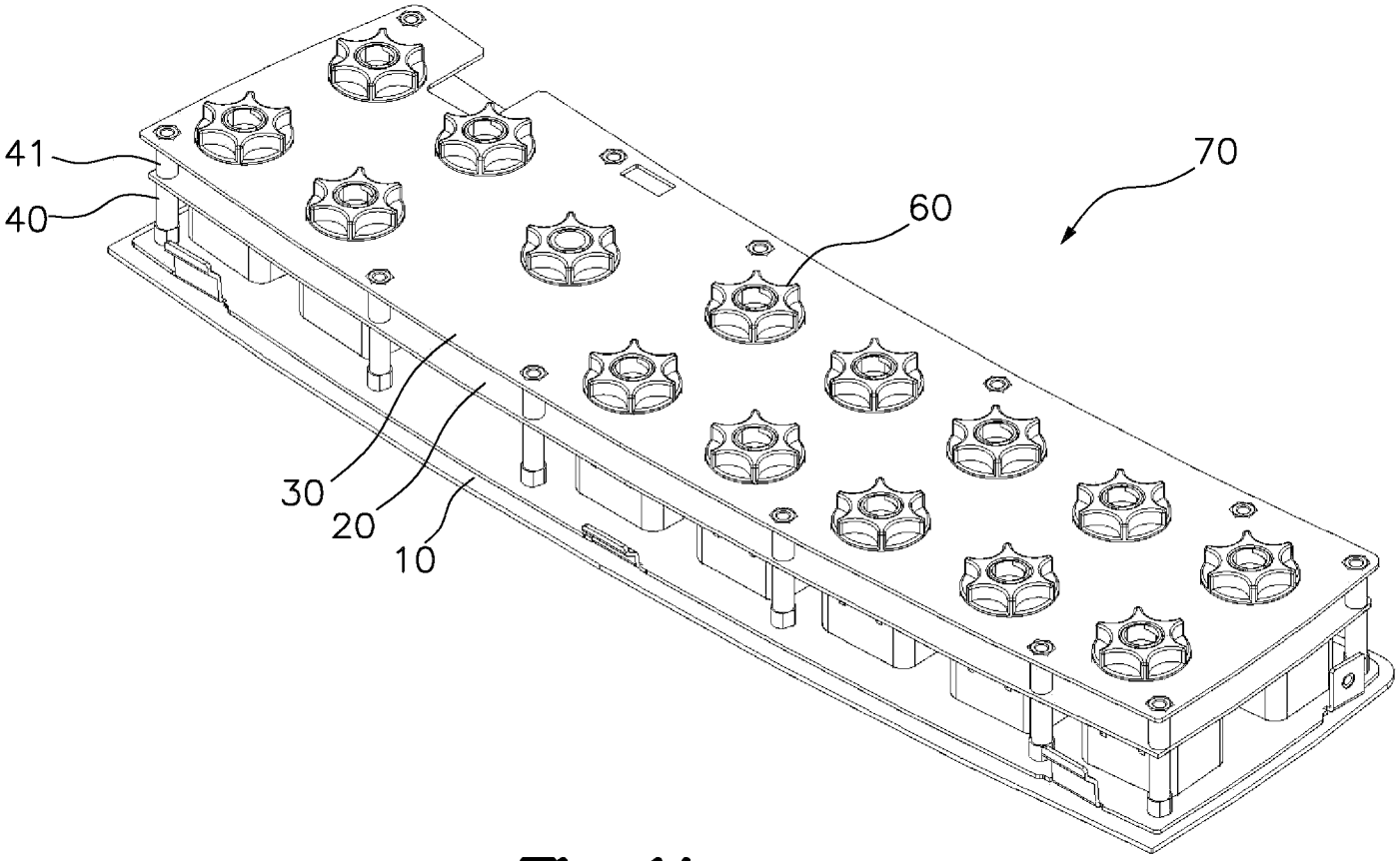
FIG. 1B shows an axonometric view of an arrangement of pushbutton switches with a programmable display included in a support structure, the side provided with the shielding plate and the securing nuts of the push-buttons being visible.
Figure 2:
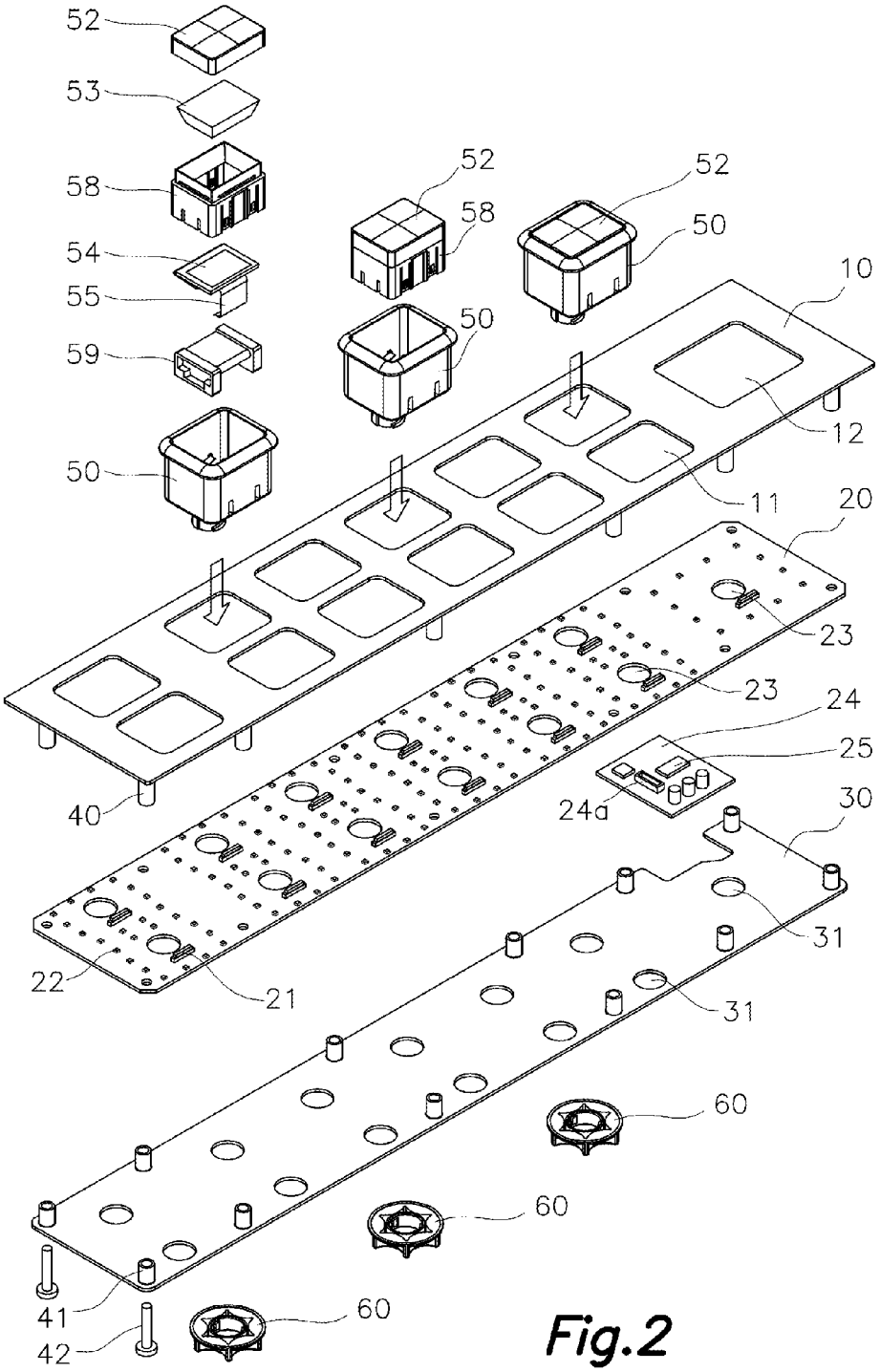
FIG. 2 is an exploded axonometric view wherein the elements conforming the support structure are shown, as well as an exploded view of the first push-button with its main components, a second push-button with the elements conforming the actuator member being mounted, while it is shown removed from the enclosure body, and a third fully mounted push-button, shown removed from the support structure.

Said arrangement of pushbutton switches is formed by means of a support structure 70 that comprises, as shown in FIGS. 1 and 2:

- an assembly panel 10 provided with a plurality of openings 11, 12 for arranging there through the enclosure body 50 of each pushbutton switch of the arrangement, with the support of a bezel 50*a* on said panel 10;
- a printed circuit board 20 wherein connection and/or control elements of said display 54 and switch are arranged;
- a shielding plate 30 of said printed circuit board 20; and
- separating columns 40 41 and attachment means 42 linking said panel 10, printed circuit board 20 and plate 30 in an overlapping arrangement.

Figure 3:
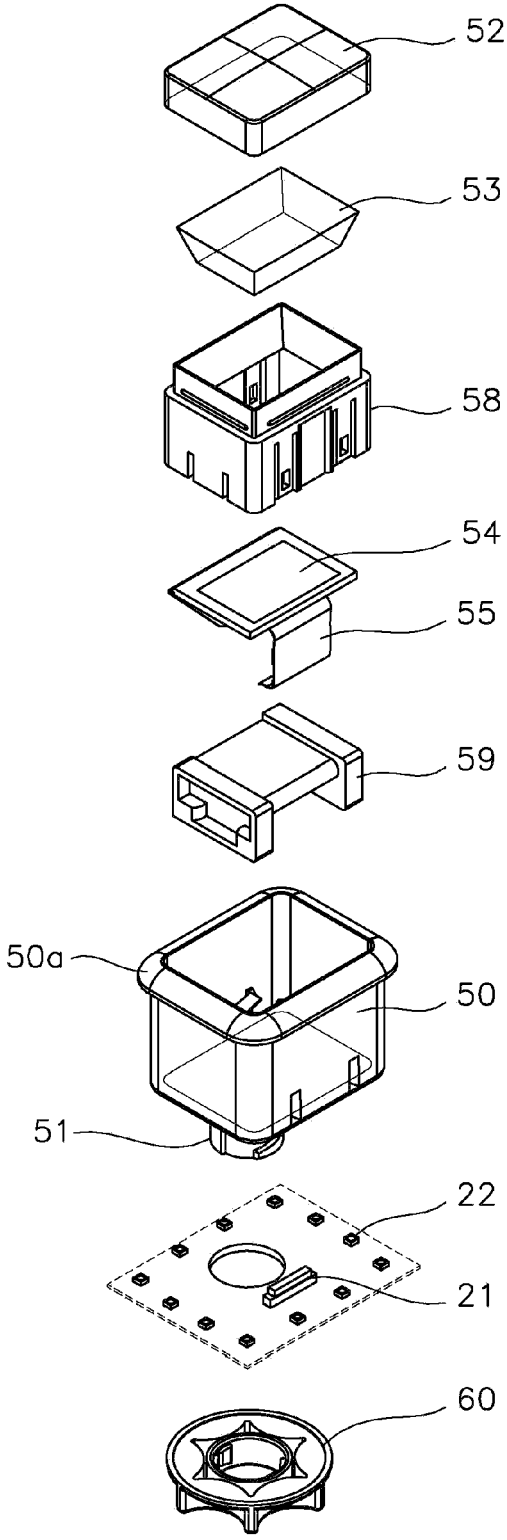
FIG. 3 shows an enlarged exploded axonometric view of all the main components of the push-button, together with a portion of the printed circuit board provided with LEDs wherein said push-button is included.
Figure 4:
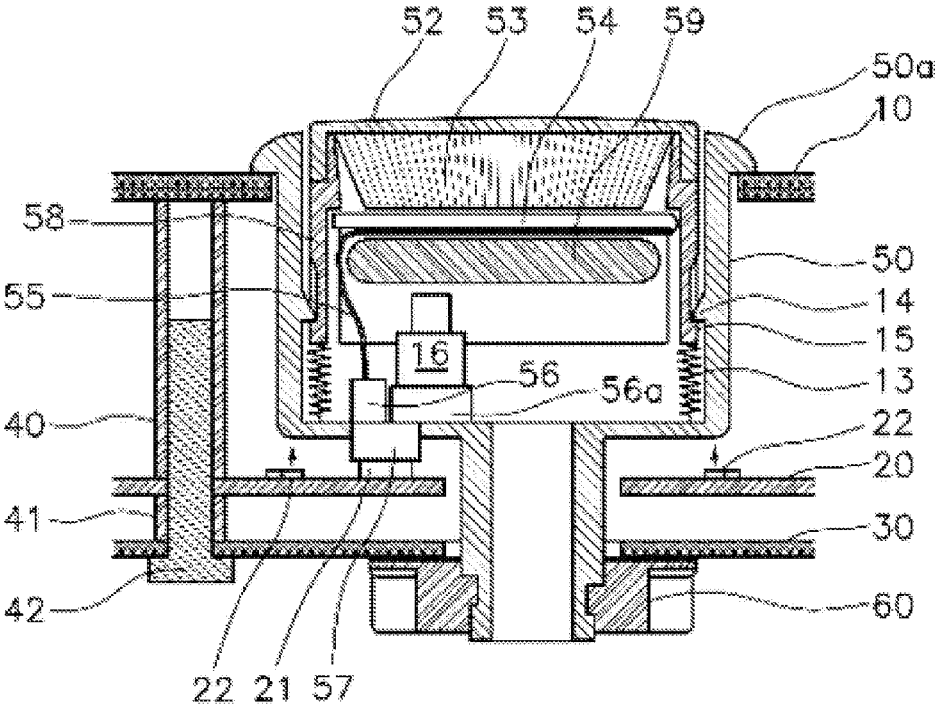
FIG. 4 shows an enlarged cross-sectional view of a push-button engaged with the support structure.

According to this invention, the enclosure body 50 of each of the pushbutton switches comprises, as shown in FIG. 3 and especially in FIG. 4:

- at least one appendix being arranged through openings 11, 23, 31 defined in said panel 10, printed circuit board 20 and plate 30, said openings 11, 23, 31 facing each other in said support structure 70, as shown in FIG. 4; and
- at least one connector 57 attached to the enclosure body 50 that is opposite to and engaged with, in an assembled situation, a connector 21 provided and arranged in the printed circuit board 20 for connecting said display 54 and said micro switch 16.

Each enclosure body 50 is attached to the support structure 70 by removable immobilizing means of said appendix relative to said shielding plate 30.

The enclosure body 50, according to a structure known per se, has a cup shaped configuration that incorporates a connector 56 in its bottom for a flexible, flat, multifilament conductor 55 of said display 54, and said appendix is made up by a tubular shaft 51 that extends from the bottom of the enclosure body 50.

For the embodiment shown in FIG. 4, the enclosure body 50 comprises a second connector 56*a* for the connection of the micro switch 16, being both connectors 56, 56*a* electrically connected to the connector 57.

For another embodiment, not illustrated, at the bottom of the enclosure body 50 a small printed circuit board is arranged, to which the connector 56 and the micro switch 16 are attached (the latter, directly or through the second connector 56*a*), and their metallic terminals are welded to conductive tracks of the small circuit printed board, said small printed circuit board being configured and arranged to electrically connect the connector 57 with the connector 56 (and thus with the display 54) and with the micro switch 16.

On the other hand, although not shown in the appended figures, two connectors are arranged at the lower face of the printed circuit board 20, one for electrical supply thereof and the other for bidirectional data communication (such as a USB connector) with a "host" of central computer, for example of an amusement machine, allowing the hot connexion/disconnection, i.e. the hot swap, of the whole assembly with respect to said host, to which purpose the latter must be prepared, both at a hardware (electrical protection devices) and at a software level.

Said immobilizing means comprise, in a preferred embodiment, a nut 60, for instance a bayonet coupling one, associable to said tubular shaft 51, which includes a complementary coupling configuration, so that said nut 60 is tight against said shielding plate 30.

The printed circuit board 20 includes one or several LEDs 22 that, in an assembled situation, are close to walls of said enclosure body 50, which is made of a light-conducting material so that the lighting of said LEDs is transferred through the enclosure body 58 to said bezel 50*a* above the panel 10. This printed circuit board and/or an auxiliary board includes a microcontroller 25 (in FIG. 2 it is the auxiliary board 24 the one which includes the microcontroller 25) governing all the displays 54 and the operation of the lighting LEDs 22 of the pushbutton switches of the arrangement. The printed circuit board 20 further includes, in its face opposite the push-buttons, connectors for connecting other standard pushbutton switches lacking an OLED display.

The display 59 of each pushbutton switch is made up by a set of organic light-emitting diodes OLEDs, and the control device of each display is arranged on the printed circuit board 20 or on said auxiliary board 24 connected to said printed circuit board 20, for example through a connector 24*a* of the auxiliary board 24 to be coupled to a complementary connector (not shown) of the printed circuit board 20. The display 54 is retained inside an actuator body 58 (constituting the above called actuator member 58) by a support 59 presenting jambs that are clamped by side elastic pins of the push-button actuator 58. The actuator body 58 comprises a first housing for said display 54 and a second housing above thereof for a lens 53 and a cover 52.

As can be seen in FIG. 2, the panel 10 comprises openings 11, 12 of at least two sizes so as to house push-button bodies 50 of different dimensions.

The invention claimed is:

1. An arrangement of pushbutton switches with a programmable display, each of the pushbutton switches comprising:

an enclosure body;

a microswitch affixed to said enclosure body an actuator member having limited linear shift play inside the enclosure body, said microswitch being activated by said linear shift when the pushbutton switch is operated; and a programmable display arranged, in the enclosure body; said arrangement of pushbutton switches including a support structure comprising:

an assembly panel provided with a plurality of openings for arranging there through the enclosure body of each pushbutton switch of the arrangement, with the support of a bezel on said assembly panel;

a printed circuit board wherein connection and/or control elements of said display and microswitch are arranged;

a shielding plate of said printed circuit board;

separating columns and attachment means linking said assembly panel, printed circuit board and plate in an overlapping arrangement, wherein the enclosure body of each of the pushbutton switches comprises:

at least one appendix integral to the enclosure body and arranged through through-openings defined in said panel, printed circuit board and shielding plate, said openings facing each other in said support structure; and at least one connector attached to the enclosure body that is opposite to and engaged with, in an assembled state, a corresponding connector provided and arranged on the printed circuit board for connecting said programmable display and said microswitch, wherein each enclosure body is attached to the support structure by removable immobilizing means of said appendix with respect to said shielding plate, the appendix comprising by a tubular shaft that extends from the bottom of the enclosure body, and the immobilizing means comprising a nut with a coupling configuration to be coupled to the tubular shaft by a respective complementary coupling configuration integrated with or attached to the tubular shaft, so that the nut is coupled against said shielding plate, and wherein the programmable display of each of the pushbutton switches is arranged in the actuator member.

2. An arrangement of pushbutton switches according to claim 1, wherein said enclosure body has a cup-shaped configuration that incorporates one of said at least one in its bottom for a flexible, flat, multifilament conductor of said display, and a secondary connector for connecting said microswitch.

3. An arrangement of pushbutton switches according to claim 1, wherein said complementary coupling configuration is a bayonet coupling configuration.

4. An arrangement of pushbutton switches according to claim 1, wherein said printed circuit board includes one or several LEDs that, in an assembled situation, are adjacent to walls of said enclosure body, which is made of a light-conducting material so that a lighting of said one or several is transferred through the enclosure body to said bezel above the panel.

5. An arrangement of pushbutton switches according to claim 1, wherein said programmable display comprises organic light-emitting diodes OLEDs, and wherein a control device of each display is arranged on the printed circuit board or on an auxiliary board connected to said printed circuit board.

6. An arrangement of pushbutton switches according to claim 1, wherein said display is retained inside an actuator body.

7. An arrangement of pushbutton switches according to claim 1, wherein said assembly panel comprises openings of at least two sizes so as to house pushbutton enclosure bodies of different dimensions.

8. An arrangement of pushbutton switches according to claim 5, wherein said printed circuit board and/or said auxiliary board includes a microcontroller governing all the programmable displays of the pushbutton switches of the arrangement.

* * * * *